US008931130B2

(12) United States Patent
Dumas et al.

(10) Patent No.: US 8,931,130 B2
(45) Date of Patent: Jan. 13, 2015

(54) DEVICE FOR CLEANING A FOOD CUTTER GRATING DISC

(75) Inventors: Pierre Bernard Claude Dumas, Saint-Romain-sous-Gourdon (FR); Loic Xavier Fevre, Sanvignes les Mines (FR)

(73) Assignee: Hameur SA, Houwald (LU)

( * ) Notice: Subject to any disclaimer, the term of this patent is extended or adjusted under 35 U.S.C. 154(b) by 618 days.

(21) Appl. No.: 12/836,803

(22) Filed: Jul. 15, 2010

(65) Prior Publication Data

US 2011/0011421 A1 Jan. 20, 2011

(30) Foreign Application Priority Data

Jul. 15, 2009 (FR) ..... 09 54885

(51) Int. Cl.

| | |
|---|---|
| ***B08B 1/00*** | (2006.01) |
| ***B26D 7/08*** | (2006.01) |
| *B26D 1/553* | (2006.01) |
| *B26D 3/18* | (2006.01) |
| *B26D 3/26* | (2006.01) |
| *B26D 7/18* | (2006.01) |

(52) U.S. Cl.

CPC ..... *B26D 7/088* (2013.01); *B26D 1/553* (2013.01); *B26D 3/185* (2013.01); *B26D 3/26* (2013.01); *B26D 7/1818* (2013.01)

USPC ..... 15/104.03; 15/104.062; 15/104.16; 83/168; 134/6; 134/8

(58) Field of Classification Search

CPC ..... B26D 1/553; B26D 3/185; B26D 3/26; B26D 7/088; B26D 7/1818

USPC ..... 15/104.03, 104.06, 104.16, 104.062; 83/168; 134/8, 6

See application file for complete search history.

(56) References Cited

U.S. PATENT DOCUMENTS 1,379,724 A * 5/1921 Russell ..... 83/451
D85,385 S * 10/1931 Lowitz ..... D7/673

(Continued)

FOREIGN PATENT DOCUMENTS

EP 0812766 12/1997
FR 2548573 1/1985

(Continued)

OTHER PUBLICATIONS

French Search Report dated Feb. 23, 2010.

*Primary Examiner* — Alexander Markoff
(74) *Attorney, Agent, or Firm* — IM IP Law PLLC; C. Andrew Im

(57) ABSTRACT

This invention relates to a device for cleaning a grating disc used for cutting food. The grating disc has two sets of parallel blades, the blades delineating quadrilateral-sectioned spaces in a main plane of the grating disc, a main plane of each blade being substantially perpendicular to the main plane of the grating disc. The device has at least one tooth, the tooth being sized such that it is able to be inserted into the spaces delineated by the blades. The device including a pin aligned with the tooth or teeth, an end of the pin protruding relative to one end of the tooth or teeth. The pin being capable of sliding into a space delineated by the blades at the same time that the tooth or teeth are inserted into one or more spaces delineated by the blades. This invention also relates to a set for cleaning a grating disc, comprising such a device. Finally, this invention relates to a method for cleaning a grating disc used for cutting food.

11 Claims, 2 Drawing Sheets

(56) References Cited

U.S. PATENT DOCUMENTS

| | | | | | |
|---|---|---|---|---|---|
| 2,226,317 | A | * | 12/1940 | Myers | 241/166 |
| 2,283,029 | A | * | 5/1942 | Bakewell | 83/435.19 |
| 2,283,030 | A | * | 5/1942 | Bakewell | 83/679 |
| 2,407,924 | A | * | 9/1946 | Garfunkel | 83/435.19 |
| 2,559,554 | A | * | 7/1951 | Zahner et al. | 83/563 |
| 2,713,718 | A | * | 7/1955 | Hudson | 30/200 |
| 3,032,087 | A | * | 5/1962 | Rodwick | 241/92 |
| 3,145,743 | A | * | 8/1964 | Cronheim | 83/466.1 |
| 3,800,649 | A | * | 4/1974 | Chinn | 83/651.1 |
| 4,383,365 | A | * | 5/1983 | Metzigian | 30/114 |
| 4,852,256 | A | * | 8/1989 | Schoettler | 30/114 |
| 5,271,317 | A | * | 12/1993 | Aguerrevere et al. | 99/538 |
| 5,947,016 | A | * | 9/1999 | Repac et al. | 99/538 |
| 6,209,439 | B1 | * | 4/2001 | Repac et al. | 83/858 |
| 2010/0154660 | A1 | * | 6/2010 | Beber et al. | 99/537 |
| 2010/0175569 | A1 | * | 7/2010 | Aby-Eva et al. | 99/537 |
| 2011/0049279 | A1 | * | 3/2011 | Beber et al. | 241/88 |

FOREIGN PATENT DOCUMENTS

| | | |
|---|---|---|
| WO | WO 2005/090029 | 9/2005 |
| WO | WO 2009/012014 | 1/2009 |

* cited by examiner

DEVICE FOR CLEANING A FOOD CUTTER GRATING DISC

FIELD OF THE INVENTION

This invention relates to a device for cleaning a grating disc used for cutting food. More precisely, this invention relates to a device for cleaning a grating disc, said grating disc comprising part of a food processing apparatus, such as a vegetable cutter.

BACKGROUND

Diced mixed preparations are commonly used in cuisine. They consist of a mixture of several fruits or vegetables. The largest fruits or vegetables are generally diced, so as to offer a preparation comprised of items of uniform size.

There are known food processing apparatuses, capable of cutting fruits or vegetables into pieces, including dicing or cubing. These apparatuses typically include a knife that cuts slices of food to be processed. Each slice is then applied to a grating disc with two sets of parallel blades, the blades having a cutting edge facing the slice. Pressure is exerted on the slice in the direction of the blades, which ensures that said slice is diced. Such a food processing apparatus is described in patent FR2548573.

In the prior art, it is traditional that the diced food is ejected from the grating disc by introducing a new slice to be cut. After finished using the apparatus, the diced food formed by cutting the last slice therefore remains in the space between the blades of the grating disc. Also, when cutting, lumps of food debris forms on some parts of the grating disc.

Cleaning such a grating disc then requires relatively long and tedious work, aimed at clearing scraps of cut food from the blades of the grating disc. Such a cleaning step can cost the user of the machine a significant amount of time.

To eject the diced vegetables from between the blades, it is known to use comb-like accessories. Such combs have teeth whose shape is substantially complementary to the spaces delineated by the blades of the grating disc. Said teeth are sized and spaced so as to be simultaneously inserted into said spaces delineated by the blades of the grating disc. The diced vegetables are then expelled from the grating disc by the teeth of the comb.

However, a user must often try several times to insert the teeth of the comb between the blades of the grating disc. The blades may come up against the end of the teeth. When the surface of the grating disc is covered with lumps of food debris, the user has difficulty seeing the blades, and it is even more difficult to correctly position the comb.

SUMMARY

This invention solves these problems and provides a more efficient device for cleaning food cutter grating discs.

One aspect of this invention in fact relates to a comb device, having a pin aligned with the teeth of said comb. One end of the pin protrudes from one of the of teeth. The shape of the pin is such that said pin is capable of sliding into a space delineated by the blades.

Thus, when the user uses the comb device to clean a grating disc, he starts by inserting the pin into a space delineated by the blades of said grating disc. The pin then serves as a guide for inserting the teeth of the comb into the other spaces. This pin guiding makes it easier to use the comb device.

One aspect of this invention therefore relates to a device for cleaning a grating disc used for cutting food, said grating disc comprising two sets of parallel blades, the blades delineating quadrilateral-sectioned spaces in a main plane of the grating disc, a main plane of each blade being substantially perpendicular to the main plane of the grating disc, said device having at least one tooth, said tooth being sized so as to be able to be inserted into the spaces delineated by the blades; said device being characterized in that it comprising a pin aligned with the tooth or teeth, one end of said pin protruding relative to one end of the tooth or teeth, the pin being capable of sliding into a space delineated by the blades at the same time that the tooth or teeth are inserted into one or more spaces delineated by the blades.

According to a preferred form of the invention, a part of the pin has a quadrilateral section, substantially complementary to the section of the spaces delineated by the blades.

According to a preferred form of the invention, the end of the pin, protruding relative to the ends of the tooth or teeth, has a substantially tapered shape. This shape makes it easier to insert the pin into the spaces delineated by the blades.

According to a preferred form of the invention, the device has several sets of teeth and pins, with different sizes and/or shapes. In fact, food processing apparatuses generally include multiple grating discs, which produce different sized pieces of food. It is more convenient for a user to have the means for cleaning each grating disc together in a single device.

Another aspect of this invention relates to a set for cleaning a grating disc used for cutting food, said grating disc having two sets of parallel blades, the blades delineating quadrilateral-sectioned spaces in a main plane of the grating disc, a main plane of each blade being substantially perpendicular to the main plane of the grating disc, said set including a scraper to remove food from the surface of the grating disc, said scraper having a plate with an edge, said set also including a comb cleaning device as described above.

The scraper can scrape away lumps of vegetable debris that may accumulate on the surface of the grating disc. It is then easier for the user to insert the comb cleaning device into the spaces delineated by the blades of the grating disc.

According to a preferred form of the invention, the set also comprises a seating having a space capable of accommodating the grating disc, said seating also having a tank located under said space. This seating allows the grating disc to be set on a stable surface before cleaning. The presence of a tank also collects pieces of food that are ejected by the comb device.

According to a more preferred form of the invention, the seating has two spaces of different sizes and/or shapes, capable of accommodating different sized grating discs, said two spaces being located on two opposite faces of said seating. Such a seating allows two grating discs of different sizes and/or shapes to be handled.

According to a preferred form of the invention, the set also includes a handle equipped with a means for reversible assembly of the seating. Soaking the grating disc in very hot water is useful for completing the cleaning of said grating disc. Using such a handle, an operator can place the grating disc and the seating in a bowl of hot water, without his hands coming into contact with the water. Risks of burns are thus prevented.

According to a preferred form of the invention, the set also includes a substantially cylindrical rod, whose section is thinner than the section of a space delineated by the blades of the grating disc. This rod makes it possible to clean the spaces delineated by the blades and located on the periphery of the grating disc.

Another aspect of this invention relates to a method for cleaning a grating disc used for cutting food, said grid comprising two sets of parallel blades, the blades delineating the quadrilateral-sectioned spaces in a main plane of the grating disc, a main plane of each blade being substantially perpendicular to the main plane of the grating disc, said method comprising the following steps:

Scraping away food found on a surface of the grating disc, using a scraper with a plate that has an edge;

Inserting at least one tooth and/or the pin of a comb device, as described above, into the quadrilateral-sectioned spaces, each space of the quadrilateral-spaced section being penetrated at least once by a tooth or a pin.

BRIEF DESCRIPTION OF THE DRAWINGS

The invention will be better understood upon reading the following description and studying the figures that accompany it. They are given for illustrative purposes and are not limiting to the invention. The figures show.

DETAILED DESCRIPTION

Figure 1:
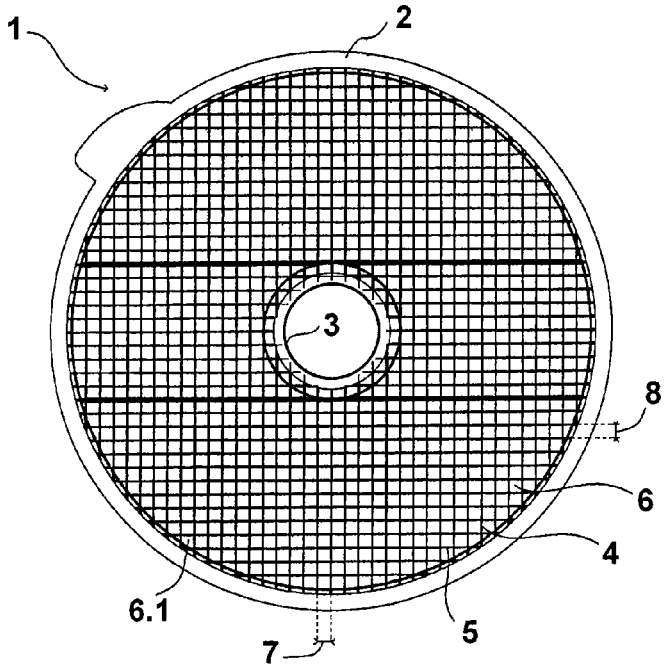
FIG. 1: A top view of a grating disc designed for cutting food.

FIG. 1 shows a top view of a grating disc designed for cutting food. The grating disc 1 includes a crown 2, with a substantially cylindrical shape. Typically, this is a revolving cylinder. Thus, on a main plane of the grating disc, parallel to the plane in FIG. 1, the grating disc 1 defines a surface in the shape of a disc.

The grating disc 1 includes a central ring 3, for instance allowing a drive shaft from a food processing device to pass through.

Between the crown 2 and the ring 3, the space on the grating disc 1 includes a first set of blades 4, arranged parallel to one another. Said space has a second set of blades 5, arranged parallel to one another. The blades (4, 5) are substantially flat, the plane of said blades being perpendicular to the main plane of the grating disc 1 and the plane in FIG. 1. The blades (4, 5) are typically made of metal, such as stainless steel.

In the example shown in FIG. 1, the blades 4 are perpendicular to the blades 5, delineating the square-sectioned spaces 6. However, a different orientation of the blades 4 relative to the blades 5 could be chosen, to delineate the diamond-sectioned spaces 6.

In the example shown in FIG. 1, a gap 7 between two juxtaposed blades 4 is equal to a gap 8 between two juxtaposed blades 5. However, different gaps 7 and 8 could have been chosen to delineate rectangular-sectioned spaces 6.

Square spaces 6 delineated by the blades (4, 5) allow food to be cut into cubes, which is the most traditionally used shape for mixed or diced preparations.

As explained above, according to the operation of the device involving the grating disc 1, diced food can remain trapped in the spaces 6 after said device is used. It is therefore necessary to have a way to clean the spaces 6 delineated by the blades (4, 5) of the grating disc 1.

Figure 2B:
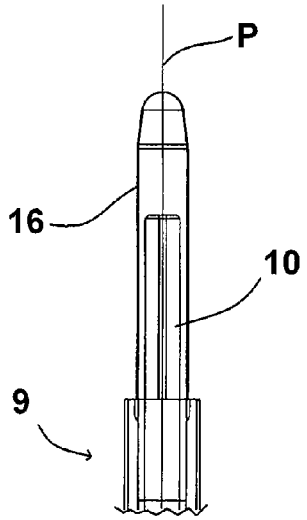
FIG. 2*b*: A side view of a detail of the device shown in FIG. 2*a;*
Figure 2A:
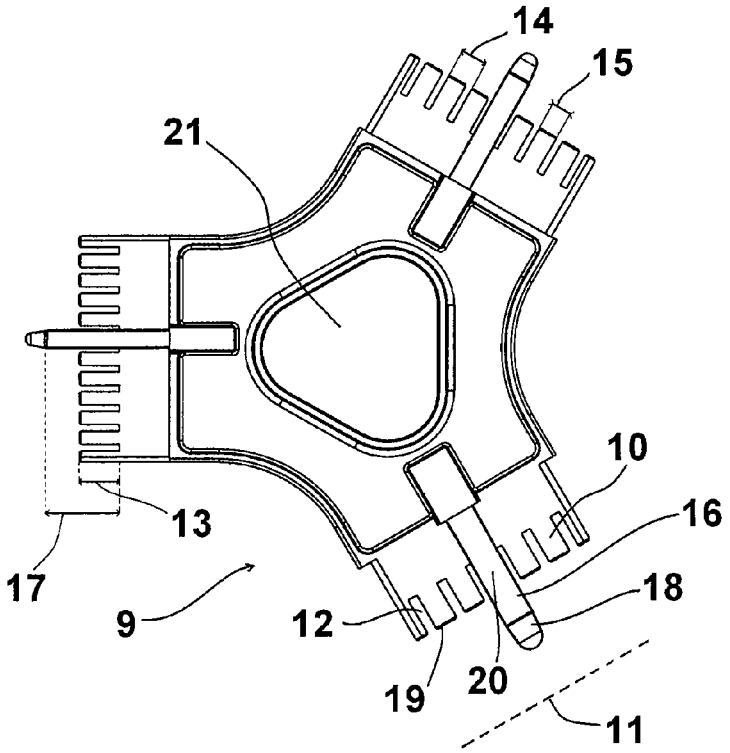
FIG. 2*a*: A top view of a grating disc cleaning device, according to one embodiment of the invention.

FIG. 2*a* shows a top view of a cleaning device, according to the invention. It is a comb device 9. Such a device can be made using metal or a plastic material, for example.

The device 9 has teeth 10. The teeth 10 are aligned along an axis 11. The axis 11 is supported by a plane P (FIG. 2*b*) of symmetry of the device 9, said plane P being parallel to the plane in FIG. 2*a*.

Preferably, a row of aligned teeth supported by the device 9 comprises three to twenty teeth 10.

In the example shown in FIG. 2*a*, the blades 10 are designed to be inserted into the square-sectioned spaces 6. The teeth 10 therefore preferably have a square section. For the diamond-sectioned or rectangular-sectioned spaces 6, it is also possible to make the teeth diamond-sectioned or rectangular-sectioned.

The teeth 10 are separated by recesses 12, into which the blades (4, 5) are lodged when cleaning the grating disc 1. Preferably, a depth 13 of a recess 12, or a length 13 of a tooth 10, is at least equal to the average height of the blades (4, 5), said height being measured perpendicularly to the main plane of the grating disc 1. Thus, a piece of diced vegetable is fully expelled from a space 6 when inserting a tooth 10 into said space 6.

The teeth 10 are sized and spaced so as to be simultaneously inserted into the spaces 6 delineated by the blades (4, 5) of the grating disc 1. More precisely, a gap 14 between two juxtaposed teeth is substantially equal to a gap 7 or 8 between two blades 4 or 5, added to a thickness of a blade 4 or 5. Thus, the teeth 10 can be simultaneously inserted into the spaces 6 of the grating disc 1.

Preferably, a side of a tooth 10 has a length 15 that is slightly less than a gap 7 or 9 between two blades 4 or 5. Thus, when the teeth 10 are inserted into the spaces 6, there is a gap between a tooth 10 and the blades (4, 5), which makes it easier to move the tooth 10 in the space 6.

According to the invention, the device 9 has a pin 16, aligned with the teeth 10 along the axis 11. A total length of the pin 16 is greater than the length 13 of the teeth 10. One end 18 of the pin 16 therefore protrudes relative to the ends 19 of the teeth 10.

This protruding end makes it possible to insert the pin 16 into a space 6, which guides the insertion of the teeth 10 into the other spaces 6 aligned with it. Preferably, when the device has multiple teeth 10, they are arranged on either side of the pin 16, which makes it easier to guide.

Preferably, the end 18 of the pin 16 has a substantially tapered shape, which makes it easier to insert into a space 6.

The taped end 18 of the pin 16 is connected to a non-tapered part 20 of said pin. Preferably, the part 20 of the pin 16 has a shape that is substantially complementary to a space 6. More precisely, a side of a section of the part 20 is substantially equal to a gap 7 or 8 between two blades 4 or 5. Thus, the pin 16 is capable of sliding into a space 6.

In a variant of the invention, the part 20 can have a shape in line with the squared-section of a space 6. The part 20 can have, for example, a circular section with a diameter 7, which allows it to slide into a space 6. However, using a part 20 with a square section allows for a better orientation of the teeth 10 relative to the row of spaces 6 penetrated by the row of said teeth 10.

Preferably, the pin 16 has a section that is slightly larger than a tooth 10, in order to minimize the gap between the pin 16 and the blades (4, 5) when inserting said pin 16 into a space 6.

Preferably, the non-tapered part 20 of the pin 16 has a length 17 that is greater than at least 10% of the length 13 of the teeth 10.

According to a preferred embodiment of the invention, a device 9 is capable of handling multiple grating discs 1, having spaces 6 with different sizes and/or shapes and able to be incorporated in a single food processing apparatus.

As in the example shown in FIG. 2A, a same device 9 can therefore have several rows of teeth 10, each row having a pin 16. Each row is arranged such that it can be insert into the spaces of a grating disc 1 without the other rows touching said grating disc 1. In the example shown in FIG. 2*a*, the device 9 has three rows of teeth 10, arranged at the top of a triangle. Each row has teeth 10 and a pin 16 of different sizes. A hole 21, located substantially at the center of the triangle, allows the device 9 to be held.

It is possible to produce variants of this device, such as by having four rows of teeth at the top of a square. It is also possible to consider a device like a Swiss Army knife, equipped with a grip to which several supports may be articulated, each of these supports having a row of teeth 10.

Figure 3:
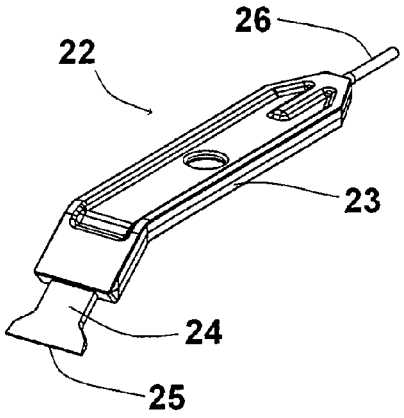
FIG. 3: An isometric view of a scraper according to one embodiment of the invention.

Another aspect of this invention relates to a set for cleaning a grating disc 1, such a set comprising a device 9, such as represented in FIG. 2*a*, and a scraper, such as represented in FIG. 3.

The scraper 22 includes a grip 23. One end of the grip 23 has a plate 24, preferably made of metal, containing an edge 25.

Using the plate 24, the scraper 22 is for cleaning the surface of the grating disc 1, in the plane in FIG. 1, especially before using the device 9. Thus, scraps of food accumulated on the top and bottom of the blades (4, 5) are eliminated, making said blades more visible and making it easier to insert the pin 16 and the teeth 10 into the spaces 6.

Another end of the grip 23 has a rod 26. This rod is substantially cylindrical, preferably with a circular, oval, or polygonal section. The section surface of the rod 26 is substantially smaller than the surface of a space 6 in the plane in FIG. 1. The function of the rod 26 is to complete the cleaning of the spaces 6.1 (FIG. 1) delineated by the blades (4, 5) and located on the periphery of the grating disc 1. In the plane in FIG. 1, the spaces 6.1 are partially delineated by the circular crown 2. These spaces have the shape of an incomplete square, so it is impossible to insert a tooth 10 from the device 9 into them. A thin rod is used to rid these spaces 6.1 of food residue. Preferably, the rod 26 has a section surface that is less than 40% of the section surface of a space 6 of the grating disc 1.

Figure 4:
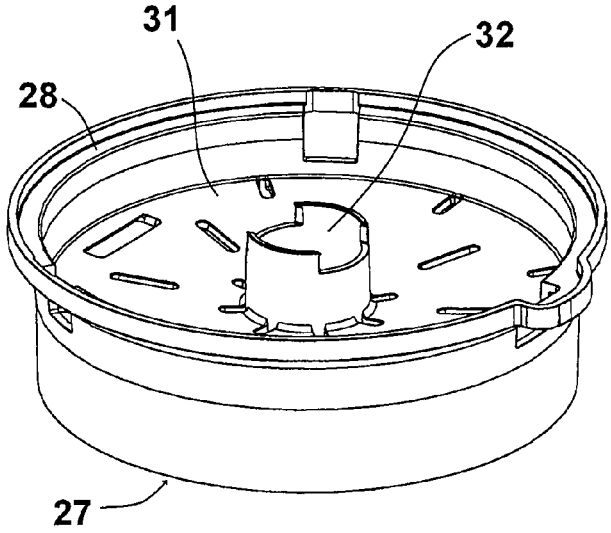
FIG. 4: An isometric view of a grating disc seating according to one embodiment of the invention.

A cleaning set according to the invention can also include a seating 27, such as shown in FIG. 4. Such seating 27 is designed to provide stable support for the grating disc 1 when it is being cleaned.

The seating 27 includes a space 29, whose shape is complementary to that of the crown 2. The accommodations for the crown 2 in the space 29 keeps the grating disc 1 from sliding laterally when it is being cleaned.

Under the space 28, the seating 27 includes a tank 31, which can accept pieces of food ejected from the grating disc 1 when the device is moving. The tank 31 can therefore collect a portion of the food remaining in the grating disc 1, when it is being cleaned.

A central part 32 of the seating 27, partially raised relative to the bottom of the tank, is used to support the central ring 3 of the grating disc 1.

The central part 32 of the seating 27 includes a slot (not shown) located in the plane at the bottom of the tank 31. Also, the plate 24 of the scraper 22 is shaped substantially like a T. One end of the plate 24 supporting the edge 25 is wider than the other end of the plate 24, connected to the grip 23.

Thus, when the grating disc 1 is placed in the space 28 of the seating 27, said seating being placed on a horizontal support, it is possible to insert the plate 24 of the scraper 22 into the slot on the support 27, and then rotate the scraper 22 a quarter turn in a horizontal plane. The T-shaped plate 24 is then blocked from moving vertically in said slot.

The grip 23 of the scraper 22 then acts as a handle to lift the entire grating disc 1/seating 27 set. It is possible to put this set in a bowl of hot water to finish cleaning, without the user having to come into contact with said hot water.

Preferably, once side of the seating 27 opposite the space 28 has another space capable of accommodating a grating disc 1 of a different size and/or shape, even with a different diameter. Similarly, the bottom of the tank 31 is shared with another tank located on the opposite side of said bottom. Thus, the same seating 27 can be used to handle two grating discs 1 of different sizes and/or shapes.

Figure 5:
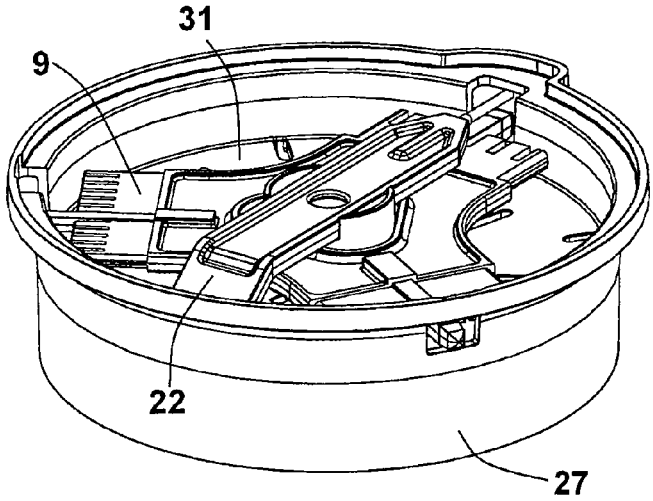
FIG. 5: An isometric view of a grating disc cleaning set according to one embodiment of the invention.

In the interest of ergonomics, it is preferable that the cleaning set comprised of the device 9, the scraper 22, and the seating 27 is arranged so as to occupy minimal space. As shown in FIG. 5, the seating 27, the device 9, and the scraper 22 are sized and configured so that the seating 27 is capable of accommodating the device 9 and the scraper 22 in the volume of its tank 31. The set is therefore easier to store, and its presentation is improved. Preferably, the grip 23 of the scraper 22 fits flexibly into the central part 32 of the seating, the device 9 being placed between said grip 23 and the bottom of the tank 31. The set is therefore secure, which makes it easier to transport.

A method according to the invention for cleaning a grating disc 1 may comprise the following steps:

- Accommodation of the grating disc 1 in the space 28 of the seating 27;
- Scraping of food on the surface of the grating disc 1, using the plate 24 of the scraper 22;
- Insertion of at least one tooth 10 and/or one pin 16 of the device 9 into the spaces 6 of the grating disc 1, each space 6 being penetrated at least once by a tooth or a pin;
- Insertion of the rod 26 into the spaces 6.1 located on the periphery of the grating disc 1.

Optionally, the tank 31 can then be emptied, the grating disc can be placed back onto the seating 27, the scraper 22 can be used on the central part 32 of said seating, the seating 27 can be lifted by vertical traction on the grip 23, and the grating disc 1 and seating 27 can be placed in a bowl of hot water to finish cleaning said grating disc 1.

The invention claimed is:

1. A set including:

a grating disc used for cutting food, said grating disc having two sets of parallel blades, said blades delineating quadrilateral sectioned spaces in a main plane of the grating disc, a main plane of each blade being substantially perpendicular to the main plane of the grating disc, a device for cleaning said grating disc, said device having at least one row of teeth, each tooth of one single row of teeth being sized such that said tooth is able to be inserted into the quadrilateral sectioned spaces delineated by the blades, said device including at least one pin, each pin being aligned with one row of teeth, an end of said pin protruding beyond the ends of the teeth of said row of teeth, each pin being configured to slide into a quadrilateral sectioned space delineated by the blades before the teeth are inserted into one or more of the quadrilateral sectioned spaces delineated by the blades, a seating having two seating spaces having at least one of different sizes or shapes, said two seating spaces being configured to accommodate grating discs having at least one of different sizes or shapes, said two spaces being located on two opposite faces of said seating, and said seating also having a tank located under at least one of said seating spaces.

2. A set according to claim 1, wherein a part of the pin has a quadrilateral section, substantially equal to a section of the quadrilateral sectioned spaces delineated by the blades.

3. A set according to claim 1, wherein the end of the pin, protruding relative to the ends of the teeth, has a substantially tapered shape.

4. A set according to claim 3, wherein a non-tapered part of the pin has a length that is greater than at least 10% of the length of a tooth.

5. A set according to claim 1, comprising several sets rows of teeth, pins aligned with the sets of teeth, each pin having at least one of different sizes or shapes with respect to other pins.

6. A set according to claim 1, further comprising a scraper to remove food from a surface of the grating disc, said scraper having a plate with an edge.

7. A set according to claim 1, further comprising a substantially cylindrical rod, having a section that is thinner than 40% of a section of one of the quadrilateral-sectioned spaces delineated by the blades of the grating disc.

8. A set according to claim 6, wherein the cleaning device, scraper and seating are sized and configured so that the seating is capable of accommodating the cleaning device and the scraper in the volume of the seating tank.

9. A set according to claim 1, wherein the pin is positioned in a center of the row of teeth.

10. A set according to claim 1, wherein the teeth have the same length.

11. A device set according to claim 1, wherein a cross-sectional area of the pin is greater than a cross-sectional area of a single tooth.

* * * * *